US008887708B2

(12) United States Patent
Kantonides et al.

(10) Patent No.: US 8,887,708 B2
(45) Date of Patent: Nov. 18, 2014

(54) MODULAR PAINTBALL MARKER

(71) Applicants: James Kantonides, Bel Air, MD (US); John Rodman, Baltimore, MD (US)

(72) Inventors: James Kantonides, Bel Air, MD (US); John Rodman, Baltimore, MD (US)

( * ) Notice: Subject to any disclaimer, the term of this patent is extended or adjusted under 35 U.S.C. 154(b) by 0 days.

(21) Appl. No.: 14/063,454

(22) Filed: Oct. 25, 2013

(65) Prior Publication Data

US 2014/0137848 A1 May 22, 2014

Related U.S. Application Data

(60) Provisional application No. 61/718,407, filed on Oct. 25, 2012.

(51) Int. Cl.
*F41B 11/71* (2013.01)
*F41B 11/722* (2013.01)

(52) U.S. Cl.
CPC ..... *F41B 11/71* (2013.01); *F41B 11/722* (2013.01)
USPC ..... 124/77

(58) Field of Classification Search
CPC ..... F41B 11/71; F41B 11/72; F41B 11/73; F41B 11/52; F41B 11/57; F41B 11/00
USPC ..... 124/71–73, 77
See application file for complete search history.

(56) References Cited

U.S. PATENT DOCUMENTS 6,349,711 B1 * 2/2002 Perry et al. ..... 124/73
6,516,791 B2 * 2/2003 Perrone ..... 124/77
6,520,172 B2 * 2/2003 Perrone ..... 124/74
6,626,165 B1 * 9/2003 Bhogal ..... 124/77
6,889,681 B1 * 5/2005 Alexander et al. ..... 124/72
7,458,370 B2 * 12/2008 Chen ..... 124/51.1
7,461,646 B2 * 12/2008 Jones ..... 124/77
7,556,032 B2 * 7/2009 Jones et al. ..... 124/73
7,591,262 B2 * 9/2009 Jones et al. ..... 124/77
7,617,820 B2 * 11/2009 Jones ..... 124/77
7,624,723 B2 * 12/2009 Gardner et al. ..... 124/1
7,762,247 B2 * 7/2010 Evans ..... 124/73
7,866,308 B2 * 1/2011 Jones et al. ..... 124/71
2001/0042543 A1 * 11/2001 Perrone ..... 124/77
2002/0088449 A1 * 7/2002 Perrone ..... 124/74
2002/0096164 A1 * 7/2002 Perrone ..... 124/77
2005/0155591 A1 * 7/2005 Forster ..... 124/74
2005/0188975 A1 * 9/2005 Rice et al. ..... 124/71
2005/0268894 A1 * 12/2005 Styles et al. ..... 124/74
2006/0011186 A1 * 1/2006 Jones et al. ..... 124/73
2006/0011187 A1 * 1/2006 Gardner et al. ..... 124/73
2006/0011188 A1 * 1/2006 Jones ..... 124/77
2006/0107939 A1 * 5/2006 Dobbins ..... 124/73
2006/0207587 A1 * 9/2006 Jones et al. ..... 124/74
2007/0068502 A1 * 3/2007 Jones et al. ..... 124/77
2007/0186916 A1 * 8/2007 Jones ..... 124/74
2007/0209650 A1 * 9/2007 Jones ..... 124/73

(Continued)

*Primary Examiner* — Michael David
(74) *Attorney, Agent, or Firm* — Ober, Kaler, Grimes & Shriver; Royal W. Craig

(57) ABSTRACT

An improved paintball marker with electro-pneumatic firing mechanism that employs two separate solenoid valves: a low pressure solenoid valve for bolt actuation and a high pressure solenoid valve for exhaust valve actuation to fire the paintball. The exhaust valve is completely independent of the bolt movement. This eliminates the need for a mechanical ram to strike the exhaust valve. Fewer moving parts and a smaller moving mass reduces recoil and improves reliability and overall operation of the marker. Moreover, the design is more modular and allows for easier disassembly and maintenance.

27 Claims, 7 Drawing Sheets

(56) References Cited

U.S. PATENT DOCUMENTS

2008/0047536 A1* 2/2008 Chen ..... 124/51.1
2008/0066729 A1* 3/2008 Evans ..... 124/73
2008/0105245 A1* 5/2008 Cole ..... 124/77
2009/0095271 A1* 4/2009 Jones ..... 124/77
2010/0282232 A1* 11/2010 Jones et al. ..... 124/80

* cited by examiner

MODULAR PAINTBALL MARKER

CROSS-REFERENCE TO RELATED APPLICATION(S)

The present application derives priority from U.S. provisional application Ser. No. 61/718,407 filed 25 Oct. 2012.

BACKGROUND OF THE INVENTION (1) Field of the Invention

The present invention relates to paintball guns ("markers") and, more particularly, to a paintball marker with a more efficient and modular electronic firing mechanism.

(2) Description of Prior Art

Paintball guns ("markers") propel paintballs by releasing a burst of CO2 or compressed air. A typical firing cycle of a paintball marker begins by a user manually cocking a bolt in the breech of the marker rearwardly in order to open a hole in the breech, through which a paintball falls into the firing chamber. Once the paintball is in the breech, the bolt is slid forward to close the breech. When the trigger is pulled a valve opens and releases compressed gas through the bolt into the breech which forces the paintball out of the marker's barrel.

Current paintball markers comprise a reservoir of compressed gas connected to a regulator that feeds regulated gas to some form of valve, and a trigger mechanism for actuating the valve to discharge the gas, ejecting paintballs from the chamber through a barrel between 280 and 300 feet per second. The barrel has a closed breech end leading to an open muzzle. A magazine of paintballs is typically mounted above the breech of the paintball marker, and the paintballs are fed into the firing position. Such paintball markers typically utilize a reciprocating bolt that moves between a loading position that permits a paintball to drop into the breech, and a firing position in which the bolt moves toward the muzzle of the marker, covering the magazine outlet. Once in the firing position the bolt re-directs a charge of compressed gas that propels the paintball out the muzzle.

Many conventional markers incorporate an electronic trigger ("eTrigger") that actuates the above-described pneumatic firing mechanism. eTriggers comprise of a manual trigger that actuates a programmable processor-based controller board. These controller boards can be programmed by insertion of pre-programmed EPROM chips to achieve semi-automatic modes, burst modes (firing one, two, three or more times with a single pull of the trigger), or fully automatic (continuous firing) modes. The various modes are determined by a software program on the EPROM, and the EPROM can be swapped out for addition of new or different modes. The particular mode is set by the user.

Existing electronic paintball marker designs tend to use an exhaust valve, either a mechanical valve and spring mechanism (poppet valve) or a spool valve, to control the airflow to the breech. With a poppet valve, a pneumatic ram is held in a first position until sufficient pressure has built up, whereby the pneumatic ram strikes the poppet valve, thereby releasing the pressurized gas stream and driving the paintball from the marker. Reciprocation of the pneumatic ram contributes to recoil, an undesirable side effect. With a spool valve, a gas chamber holds the bolt in the loading position. When this gas chamber is vented, the bolt slides forward moving the paintball into the firing position. As the bolt moves forward, an air reservoir (volume chamber) is vented by the spool valve, which opens to vent the volume chamber gas through the bolt to drive the paintball from the marker. For these conventional paintball guns, the opening of the exhaust valve (whether a poppet or a spool) is mechanically tied to the movement of the bolt or ram. This means that the bolt/ram needs to move at a sufficient speed to open the exhaust valve properly. Unfortunately, higher bolt speed correlates to a larger force on the paintball as it is moved into the firing position, contributing to breakage and paint in the breech or barrel, which is very undesirable.

The present inventors have found that it is possible to increase the reliability and smoothness of operation by use of electro pneumatic solenoid valves connected directly to the electronic trigger, and by sequentially activating the solenoid valves according to a programmed firing sequence. In their inactivated state the solenoid valves admit low pressure gas to push the bolt assembly from its forward position backward to an open position to load a paintball into the breech.

Next, at the pull of the trigger, an electronic signal actuates a low pressure LP solenoid valve which pushes compressed gas behind the bolt assembly forcing it to move forward and close the breech. A second electronic signal actuates a high pressure (HP) solenoid valve which in turn actuates an exhaust valve. This exhaust valve vents high pressure compressed gas through the bolt assembly into the chamber. The paintball is fired.

Next, HP and LP solenoid valves are deactivated. This delivers compressed gas to the front of the bolt assembly, returning it to its starting open position.

The dual solenoid valve design eliminates the need for a ram striking the valve assembly and thus reduces recoil and improves the overall operation of the paintball marker. Moreover, using two solenoid valves completely separates the bolt actuation from the opening of the exhaust valve. As a result, the firing cycle can be completed with a lower bolt speed. This reduces unwanted paintball breakage. Also, the marker can be tuned electronically, by altering timing completely via the PCB, rather than by tuning physical components.

The dual-solenoid valve configuration also simplifies the design and allows far fewer moving parts, as well as less interaction between mechanical parts. The corresponding decrease in moving mass also contributes to recoil reduction. Moreover, the marker is a more stable and reliable firing platform, and is smaller, lighter, and more modular in construction.

The net result is a high-efficiency tournament grade paintball marker that makes more efficient use of compressed gas, thereby allowing firing of more rounds per charge, and which is nevertheless simple in construction and easier to manufacture.

SUMMARY OF THE INVENTION

Accordingly, it is an object of the present invention to provide a new and improved paintball marker and method of operation that replaces conventional ram actuation with two synchronized electro-pneumatic solenoid valves to reduce moving parts, moving mass and recoil, and to conserve compressed gas.

It is another object to use a solenoid valve to directly control airflow to the breech, rather than ram striking a mechanical valve and spring mechanism (poppet valve). It is an object to eliminate the ram altogether.

It is another object to use two solenoids in order to completely separate bolt actuation from the opening of the exhaust valve, so that bolt speed can be lowered to reduce unwanted paintball breakage.

It is still another object to provide a marker that can be tuned completely electronically, by altering timing via the controller/PC Board, rather than by tuning physical components. It is another object to provide a two-piece bolt assembly in which the bolt has a removable bolt tip that threads together, allowing the player to swap out different bolt tips (for various reasons such as, for example, to quiet the gun down, increase gas efficiency, or provide a soft tip for brittle paintballs.

It is another object to provide an inline bolt assembly in which all moving parts are located in the chamber, and O-ring seals are minimized.

It is another object to provide a modular marker design for easier disassembly and maintenance.

In accordance with the foregoing and other objects, the present invention is an improved paintball marker generally comprising a body and a grip frame. A tubular barrel extends from the body, and the barrel is coupled to an internal chamber in the body. The chamber includes a breech section into which paintballs are loaded from an external hopper, and rear section configured to receive a bolt assembly. The bolt assembly is seated in the rear of the chamber. The bolt assembly moves as a unitary component (there is no piston-like ram protruding from the bolt as in conventional spool-valve electro-pneumatic markers). The bolt assembly is equipped with an annular "sail", and movement of the bolt assembly is controlled by the routing of air in front of or behind the sail. [The bolt is movable between a loading position which allows a paintball to drop into the breech, and a ready-to-fire position which pushes the paintball into the chamber. An exhaust valve releases high pressure compressed air from a volume chamber to the breech to fire the paintball, but the exhaust valve is completely independent of the bolt movement. Rather, a pair of solenoid valves control direct injection of the compressed gas, including a low pressure (LP) solenoid valve for bolt movement, and a high pressure (HP) solenoid valve for actuating the exhaust valve to release high pressure compressed air from the volume chamber into the breech. The marker has an electronic trigger in which a manual retractable trigger is connected to an electronic controller. A supply tank of compressed gas is coupled to the marker and fed through internal passages within the grip frame and body, to a high pressure regulator (HPR) for regulating the tank-pressure compressed gas to a high-pressure within a range from 100-300 psi. The HPR-regulated gas is split, one passage leading to a low pressure regulator (LP regulator), and another to the volume chamber. The LP regulator drops down the high-pressure to a low pressure of approximately 20-60 psi for controlling bolt movement. An exhaust valve expels the high pressure volume chamber for firing the paintball.

The LP compressed gas to the bolt, and the exhaust valve, are independently actuated by a pair of solenoid valves, the solenoid valves being in electronic communication with the controller for actuation by the trigger.

The pair of solenoids includes a low pressure (LP) solenoid for controlling low pressure compressed gas for moving the bolt, and a high pressure (HP) solenoid for controlling high pressure compressed gas for firing the paintball. In their first inactivated or "loading" position, the HP solenoid is closed and the LP solenoid open to admit lower pressure compressed gas into the chamber in front of the bolt for maintaining the bolt open. In this loading position a paintball is free to drop from the hopper into the breech.

In a second "ready to fire" position, the HP solenoid remains closed and the LP solenoid also closes to remove the lower pressure compressed gas from in front of the bolt. With no forward compression the bolt moves forward and closes, pushing the paintball into the chamber and closing the breech.

In a third "firing" position, the LP solenoid remains closed and the HP solenoid opens, actuating the exhaust valve to admit high-pressure compressed gas from the volume chamber directly into the breech/chamber of the marker for firing the paintball there from.

Once the paintball is fired the solenoid valves immediately return their loading position.

This firing cycle is electronically sequenced. Thus, when the trigger is pulled it contacts a microswitch mounted on the circuit board which causes the controller to send control signals sequentially to open/close the solenoids. Since the opening of the exhaust valve is not mechanically tied to the movement of the bolt (the bolt need not move fast enough to open the exhaust valve properly), the bolt speed can be slowed, and this avoids breaking of paintballs as they are moved into the firing position. The dual-solenoid valve configuration simplifies the design and allows far fewer moving parts, as well as less interaction between mechanical parts. The corresponding decrease in moving mass contributes to recoil reduction. Moreover, the marker is a more stable and reliable firing platform, and is smaller, lighter, and more modular in construction. The end product is a high-efficiency tournament grade paintball marker.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a paintball marker with a more efficient and modular electronic firing mechanism. The improved paintball marker employs an electro-pneumatic design with two solenoid valves connected directly to an electronic trigger, which synchronizes their firing sequence.

The present invention also includes an improved bolt assembly that eliminates the need for a ram to mechanically strike the exhaust valve. Rather, the bolt is a two-part inline design with a dynamic bolt. Compressed gas is injected directly in front of or behind the bolt by one of the two solenoids, for moving the bolt. The use of the solenoid valves eliminates the need for any mechanical interaction between the bolt/ram and the exhaust valve assembly, thereby reducing broken paintballs, reducing recoil, and improving the overall operation of the paintball marker.

The timed firing sequence operative via the solenoid valves also allows far fewer moving parts and simplifies the design. The decrease in moving parts (mass) also contributes to recoil reduction. Moreover, the marker is smaller, lighter, more modular in construction, and more reliable.

Figure 1:
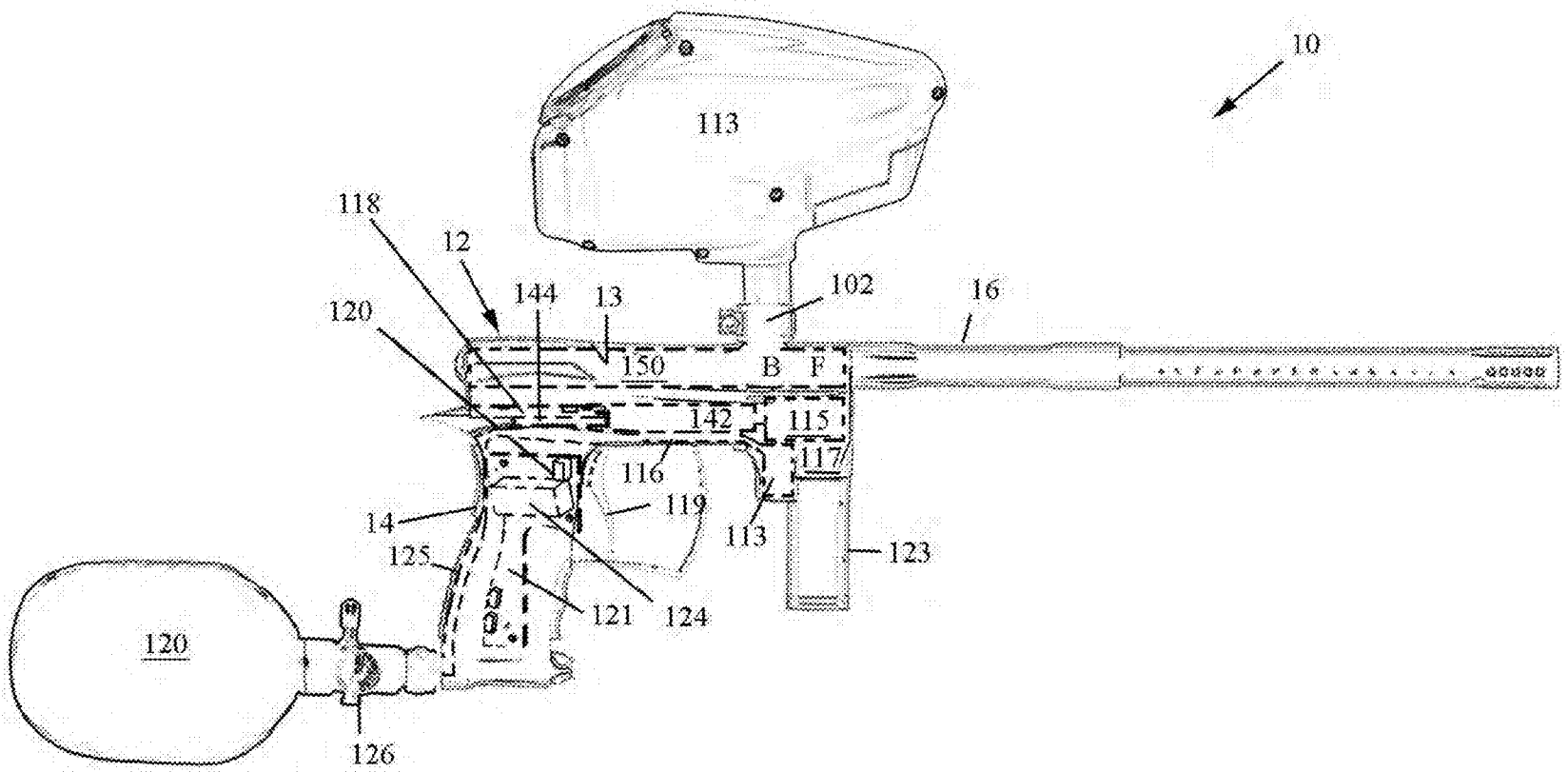
FIG. 1 is a side view of a paintball marker 10 according to an embodiment of the present invention, with modular internal components shown in dotted lines.
Figure 2:
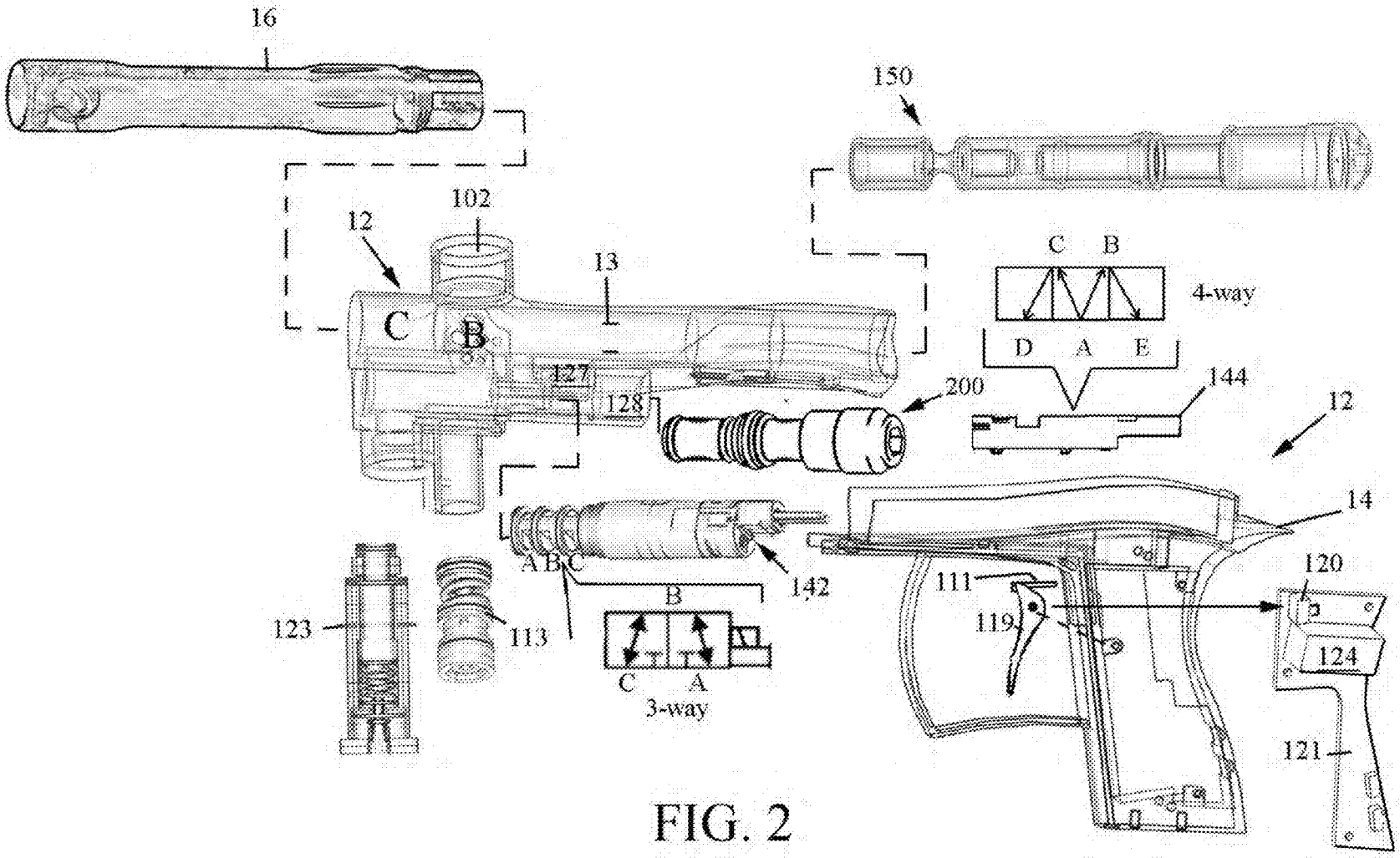
FIG. 2 is an exploded diagram of the paintball marker 10 as in FIG. 1.

FIG. 1 is a composite perspective view and FIG. 2 is an exploded view of a paintball marker 10 according to an embodiment of the present invention. The paintball marker 10 generally comprises a body 12 seated and attached within a grip frame 14, and a barrel 16 extending from the body 12. The grip frame 14 has a hollow handle that houses an E-trigger including an internal printed circuit board (PCB) 121 with a controller 124 and microswitch 120, and a retractable trigger 119 attached to the grip frame 14 and selectively engaged to the PCB microswitch. The body 12 includes an interior cylindrical bore 13 leading to a barrel assembly 16 through which a paint ball is discharged. The bore 13 opens upward through feed port 102, and through feed port 102 paintballs are gravity-fed from a hopper 113 into the breech B (see FIG. 2) of bore 13. A firing chamber F resides directly in front of breech B.

As seen in FIG. 1 a compressed gas cylinder 120 containing compressed air may be attached to the bottom of the grip frame 14 through a gas-port 126 in a known manner, for introduction of compressed gas into the cylinder bore 13 of body 12. The gas-port 126 may comprise a conventional safety-vented Air Source Adapter (ASA), and the compressed gas cylinder may include an internal tank regulator that is preferably adjustable to provide a range from 400-800 PSI output. A variety of commercially-available tank regulators are well-suited. In operation, 400-800 psi of "tank" air from an attached high pressure tank 120 goes through the gas-port 126 attached to the bottom of the grip frame 14. The high pressure gas continues through an internal air passage 125 within the grip frame, and the grip frame passage 125 is coupled to a second passage 116 in the body 125. The body passage 116 communicates with a vertically mounted high-pressure (HP) regulator 123, which drops the pressure to a "firing pressure" preferably within a range from 100-300 psi, though this may vary. HP regulator 123 is modular and is inserted into a receptacle and screwed into a port 117 in body 12. Thus, the high-pressure (100-300 psi) feed of gas travels out through the top of the HP regulator 123 and, as seen in FIG. 2, into the port 117 in body 12. The high-pressure air through port 117 is fed into a volume chamber 115. The pressurized volume chamber 115 is coupled into the firing chamber F of the cylinder bore 13 through a three-way solenoid-controlled high-pressure (HP) exhaust valve 142 for selectively directing the firing pressure gas into the firing chamber F (as will be described for firing a paintball.

The body passage 116 also communicates with a vertically mounted low-pressure (LP) regulator 113, which drops the pressure to a low pressure of approximately 20-60 psi and directs the low pressure compressed gas to a four-way solenoid-controlled low-pressure (LP) valve 144 for selectively directing the low pressure gas through a manifold 118 and into the bolt assembly 150 at the rear of cylinder bore 13 (as will be described) for actuating the bolt assembly 150.

The LP solenoid valve 144 resident below manifold 118 drives the bolt assembly 150, and is electrically connected to programmable controller circuit board 121.

Similarly the HP solenoid valve 142 which pilots the exhaust valve 200 is electrically connected to the programmable controller circuit board 121. The controller 124 on circuit board 121 is actuated by a mechanical trigger 119 bearing against a microswitch 120. Thus, when the trigger 119 is pulled, it contacts microswitch 120 mounted on the circuit board 121 and microswitch 120 causes the controller 124 to send control signals sequentially to operate both LP solenoid valve 144 and HP solenoid valve 142. Low pressure gas inputted through LP solenoid valve 144 controls the movement of the bolt assembly 150 that loads a paintball into the breech B through feed port 102 and then into firing chamber F.

The high-pressure (100-300 psi) feed of gas from HP regulator 123 fed into volume chamber 115 will, when the HP solenoid valve 142 is signaled by the controller 124 on circuit board 121 to actuate the exhaust valve 200, this exhausts the contends of the volume chamber 115 into the firing chamber F. Thus, the HP solenoid valve 142 actuates the exhaust valve 200 independently of bolt assembly 150, thereby directing gas into the firing chamber F of cylinder bore 13 which fires the paintball out of the cylinder bore 13 and down the barrel assembly 16.

The controller 124 is preprogrammed to output separate but synchronized DC signals to both the LP solenoid valve 144 and HP solenoid valve 142 to implement an "open bolt" firing sequence comprising three repeating steps: 1) loading; 2) ready to fire; and 3) fire. In the open bolt sequence, when the marker 10 is at rest, the bolt assembly 150 is in the "back" position, and a paintball is free to fall into the breech B. One skilled in the art will readily understand that the firing sequence may be re-programmed to a closed bolt sequence where, in the rest position, the bolt assembly 150 is forward such that the paintball to be fired is in the firing chamber F and the breech B is closed off.

In the first inactivated or "loading" position of the open bolt sequence, the HP solenoid valve 142 is closed and the LP solenoid valve 142 open to admit lower pressure compressed gas into the cylinder chamber 13 in front of the bolt assembly 150 to keep the bolt open. In this loading position a paintball is free to drop from the hopper into the breech B.

In a second "ready to fire" position, the HP solenoid valve 142 remains closed and the LP solenoid valve 144 also closes to remove the lower pressure compressed gas from in front of the bolt assembly 150. With no forward compression the bolt moves forward and closes, pushing the paintball into the firing chamber F and closing the breech.

In a third "firing" position, the LP solenoid valve 144 remains closed and the HP solenoid valve 142 opens, actuating the exhaust valve to admit high-pressure compressed gas directly into the firing chamber F of the marker for firing the paintball out of the barrel 16.

Once the paintball is fired both solenoid valves 142, 144 immediately return the loading position.

The HP solenoid valve 142 is a three-way poppet-type solenoid-controlled valve having three ports A-C. One pair of adjacent ports A, B forms a first pneumatic switch, and the other pair of adjacent ports B, C forms a second pneumatic switch. The HP solenoid valve 142 is preferably a universal valve, meaning that all ports seal off internally at full pressure in all directions such that it doesn't matter if a port is pressurized or not. When one pair of adjacent ports A,B is open, the others B,C are closed and vice versa. The port diagram is shown in the inset below in FIG. 2. The LP solenoid valve 142 may be, for example, a 3-way bullet valve part number BV-309A-CD1-00-BGLA-CTA available from MAC, Inc., or equivalent SMC, Inc. valve will suffice.

The LP Solenoid valve 144 is preferably a 4-way universal poppet valve mounted directly to the body 12 with screws. A manifold 118 (and underlying gasket) is sandwiched between the LP solenoid valve 144 and body 12. The port diagram is shown in the inset above in FIG. 2, where port A is connected to the LP REGULATOR 113 inlet, port B is a normally-open work port that ports air in front of the bolt assembly 150, port C is a normally closed work port that ports air behind the bolt, port D is a vent for work port B, and port E is a vent for work port C. The LP solenoid valve 144 may be, for example, an SMC, Inc. series SYJ3000 four port solenoid valve.

The solenoid valve 142, 144 firing sequence is as follows.

| | LP solenoid valve 144 | HP solenoid valve 142 |
|---|---|---|
| Loading | 0 vdc | 0 vdc |
| Ready to fire | +12 vdc | 0 vdc |
| Firing | +12 vdc | +12 vdc |

Initially, the LP solenoid valve 144 will be in the loading position with adjacent ports A, C, E stuck open (from the previous cycle) and adjacent ports B, D closed such that the bolt/valve assembly 150 is held open to allow a paintball to fall through port 102 into the breech B of cylinder bore 13. The LP solenoid valve 144 remains in the loading position until the trigger 119 is pulled.

When the trigger 119 is pulled, it contacts microswitch 120 on the circuit board 121. The controller 120 (also on circuit board 121) selectively actuates the LP solenoid valve 144 and HP solenoid valve 142 according to a synchronized timing sequence. First, LP solenoid valve 144 is switched to the ready-to-fire position with ports A, B, D open, and ports C, E closed. This injects air behind the bolt assembly 150, removes the low pressure gas from in front of the bolt assembly 150, and pushes the bolt assembly 150 forward to close the breech Band push the paintball out of the breech B and into the firing chamber F. At the same time, HP solenoid valve 142 is actuated, and this immediately releases the exhaust valve 200, which in turn evacuates high pressure air from the volume chamber 15 into the breech B to fire the paintball. Upon completion the LP solenoid valve 144 will return to the loading position.

Figure 3:
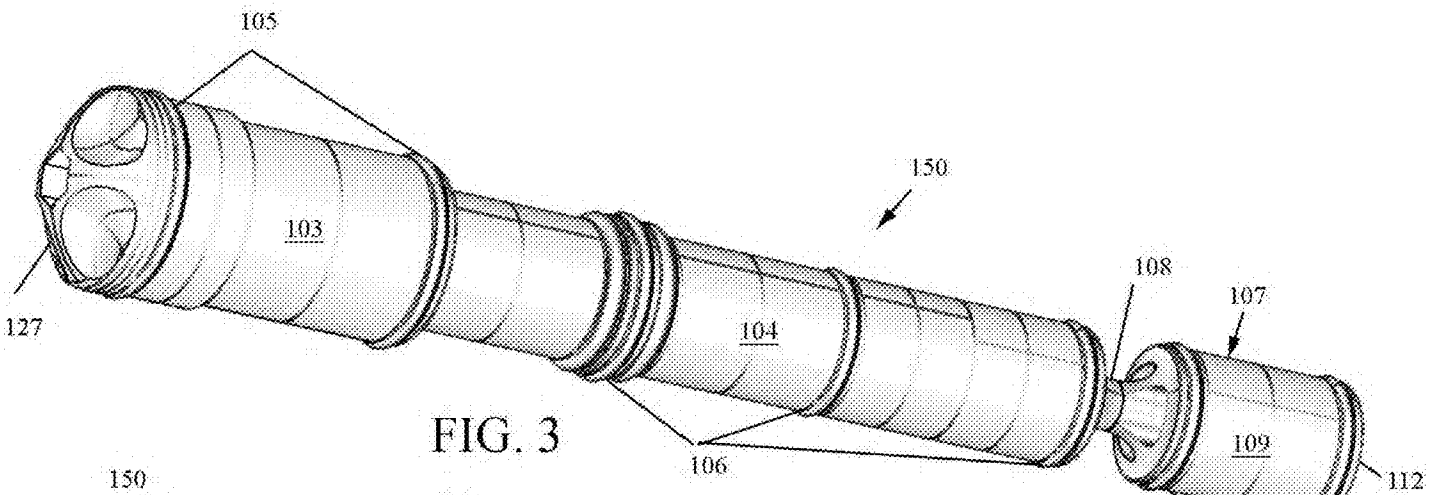
FIG. 3 is a front side perspective view of the bolt assembly 150 of FIGS. 1-2.
Figure 4:
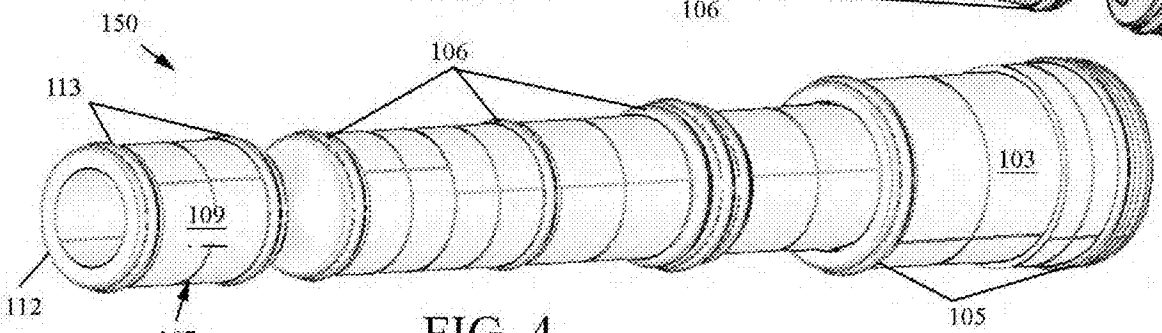
FIG. 4 is a rear-side perspective view of the bolt assembly 150.
Figure 5:
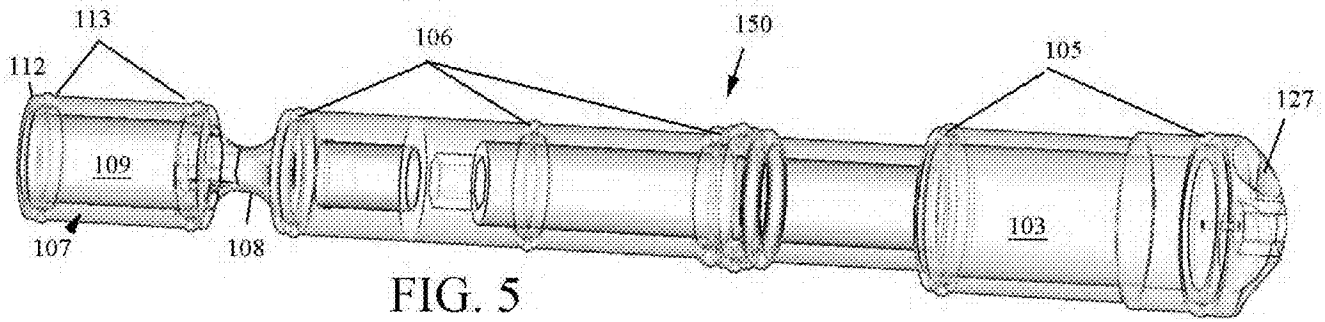
FIG. 5 is a side cross-section of the bolt assembly 150.

FIGS. 3-5 are a front side perspective view, rear-side perspective view, and cross-section, respectively, of the bolt assembly 150 of FIGS. 1-2. The bolt assembly 150 employs an inline two-piece cylindrical form located in the top cylinder bore 13 of marker 10. The bolt assembly 150 generally comprises a cylindrical mid-section 104 leading to an enlarged-diameter sail section 103 at one end. The sail section 103 occupies the back of the cylinder bore 13 of main body 12. A bolt head 107 protrudes forwardly from the other end of bolt assembly 150 for pushing paintballs into the firing chamber F. The bolt head 107 is carried at the end of a stem 108 that is screw-threaded into the mid-section 104. The reciprocating bolt assembly 150 moves as a unit between a loading position that permits a paintball to drop into the breech B, and a firing position in which the bolt head 107 pushes the paintball forward into the firing chamber. In accordance with the present invention, the bolt head 107 comprises a cylindrical stem 108 that is screw-inserted within mid-section 104, and an annular bolt tip 109 screw-inserted onto the stem 108. The bolt head 109 may be unscrewed for replacement. This two-piece bolt assembly 150 provides a unique advantage in that bolt heads 108 may be swapped out, for example, to quiet the gun down, increase gas efficiency, or provide a softer bolt head 109 tip for brittle paintballs. The bolt head 109 may be equipped with a soft rubber bumper 112 to cushion the bolt head 109 when contacting the paintball.

The bolt assembly 150 is defined by two annular channels that seat two O-rings 105 on opposing sides of the sail section 103 as shown, which simply seals the sail section 103 within the cylinder bore of main housing 12. The sail section 103 steps to a reduced-diameter mid-section 104 likewise defined by three annular channels that seat three O-rings 106 which prevent blow back pressure from the breech B. Pressure in advance of the sail section 103 will maintain the bolt assembly 150 at the rear of the cylinder bore 13, whereas once that pressure is removed internal pressure inside the bolt assembly 150 ports from a rear port 127 and moves the bolt assembly 150 forward.

The rear port 127 of the bolt assembly 150 is preferably formed as an annular cap 127 with multiple vents.

Figure 6:
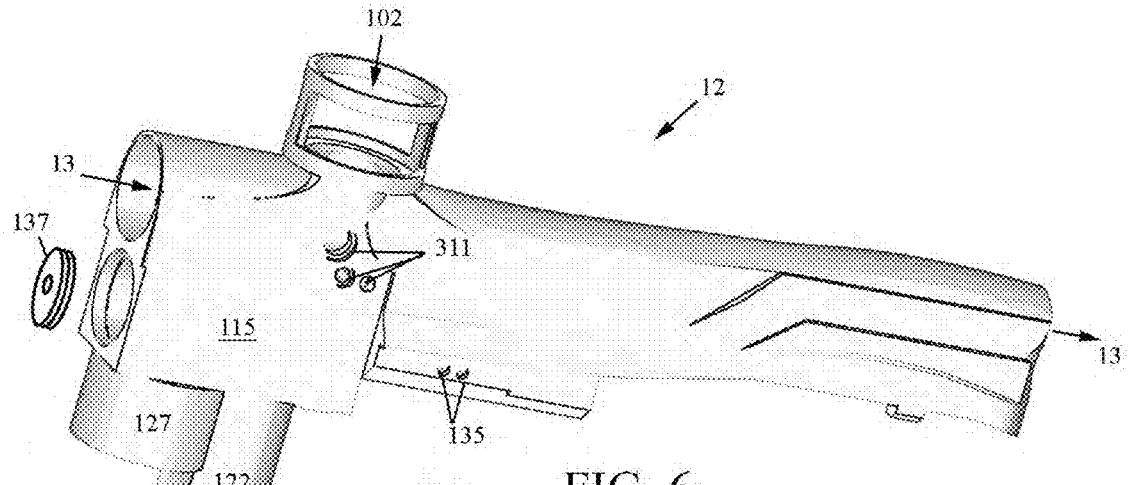
FIG. 6 is a front side perspective view of the marker body 12.
Figure 7:
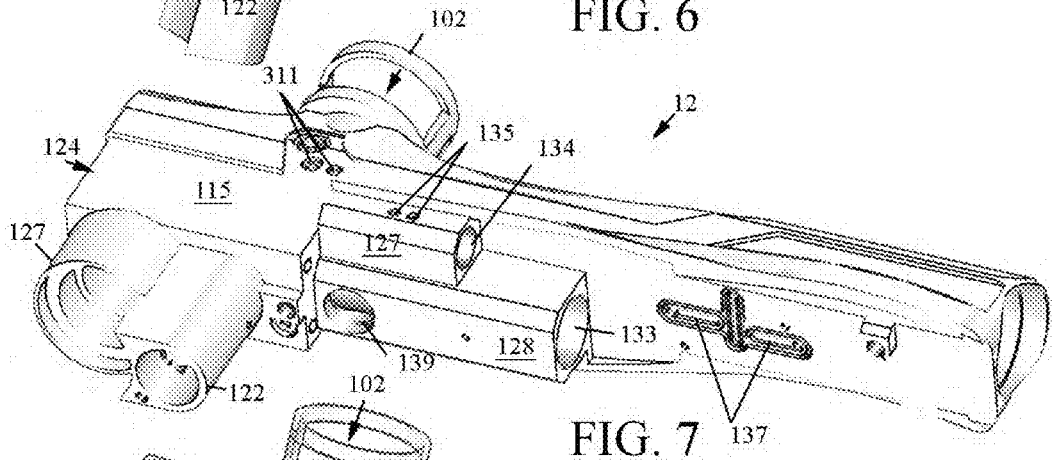
FIG. 7 is a rear side perspective view of the marker body 12.
Figure 8:
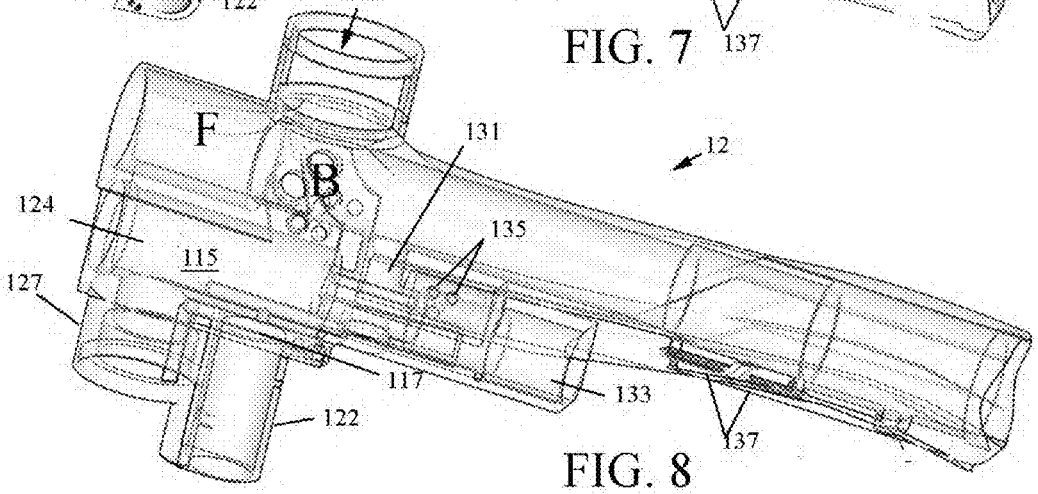
FIG. 8 is a side cross-section of the marker body 12.

HP regulator 123 is an inline moving-base regulator with spring-loaded valve core. HP regulator 123 is preferably 2-3" tall, has a maximum input of 900 psi, and an output range of 100-800 psi. The HP regulator 123 is similar to an existing DLX™ 2.0 Luxe™ regulator, including core and housing, but is adapted for screw insertion into the receptacle on body 12. Low pressure regulator 113 is also an inline moving-base regulator with valve core. LP regulator 113 is preferably 1-2" tall, has an output pressure within a range of from 20-60 psi. The LP regulator 113 is structurally similar to the HP regulator 123 but likewise is adapted for screw insertion into a receptacle in the body 12. Tank air is routed to the base of the LP regulator 113, and the regulated air comes out the top and travels through a low pressure body air passage 117 that feeds the LP solenoid valve 144. FIGS. 6-8 are a front side perspective view, rear-side perspective view, and cross-section, respectively, of the marker body 12, and FIG. 9 is a side perspective view of the grip frame 14.

The body 12 includes an interior cylinder bore 13 that traverses the entire body 12. The bore 13 opens upward through feed port 102, and through feed port 102 paintballs are gravity-fed from a hopper 113 (see FIG. 1) into the breech B of bore 13. A firing chamber F resides directly in front of breech B. The body 12 is formed with a downwardly protruding female receptacle 122 for modular insertion of low pressure regulator (LP regulator) 113. The LP regulator 113 may screw into receptacle 122 at port 117. The body is also formed with a downwardly protruding female receptacle 127 adjacent 122 for modular insertion of the HP regulator 123, which HPR 123 may screw into receptacle 127. The body 12 is formed with a sideward female receptacle 124 which is capped off by a screw cap 137 to define the volume chamber 115. The volume chamber 115 opens into the breech B of cylinder chamber 13. Receptacle 124 continues transversely through body 12 and exits the opposing side branches out from and exits through another receptacle 133 in which the LP solenoid valve 142 is seated. In addition, the passage between receptacles 124, 133 is ported up into the cylinder chamber 133 just behind the breech B at port 131. The LP solenoid valve 144 ports A-C (see FIG. 2) selectively port low-pressure compressed gas in front of the sail section 103 of bolt assembly 150 for actuation thereof in accordance with the firing sequence.

As seen in FIG. 7, the body 12 also includes a series of holes for containing "ball detents", known pin mechanisms in paintball markers designed to prevent the paintball from rolling out of the firing chamber. A recess 137 is positioned for seating manifold 118.

Figure 9:
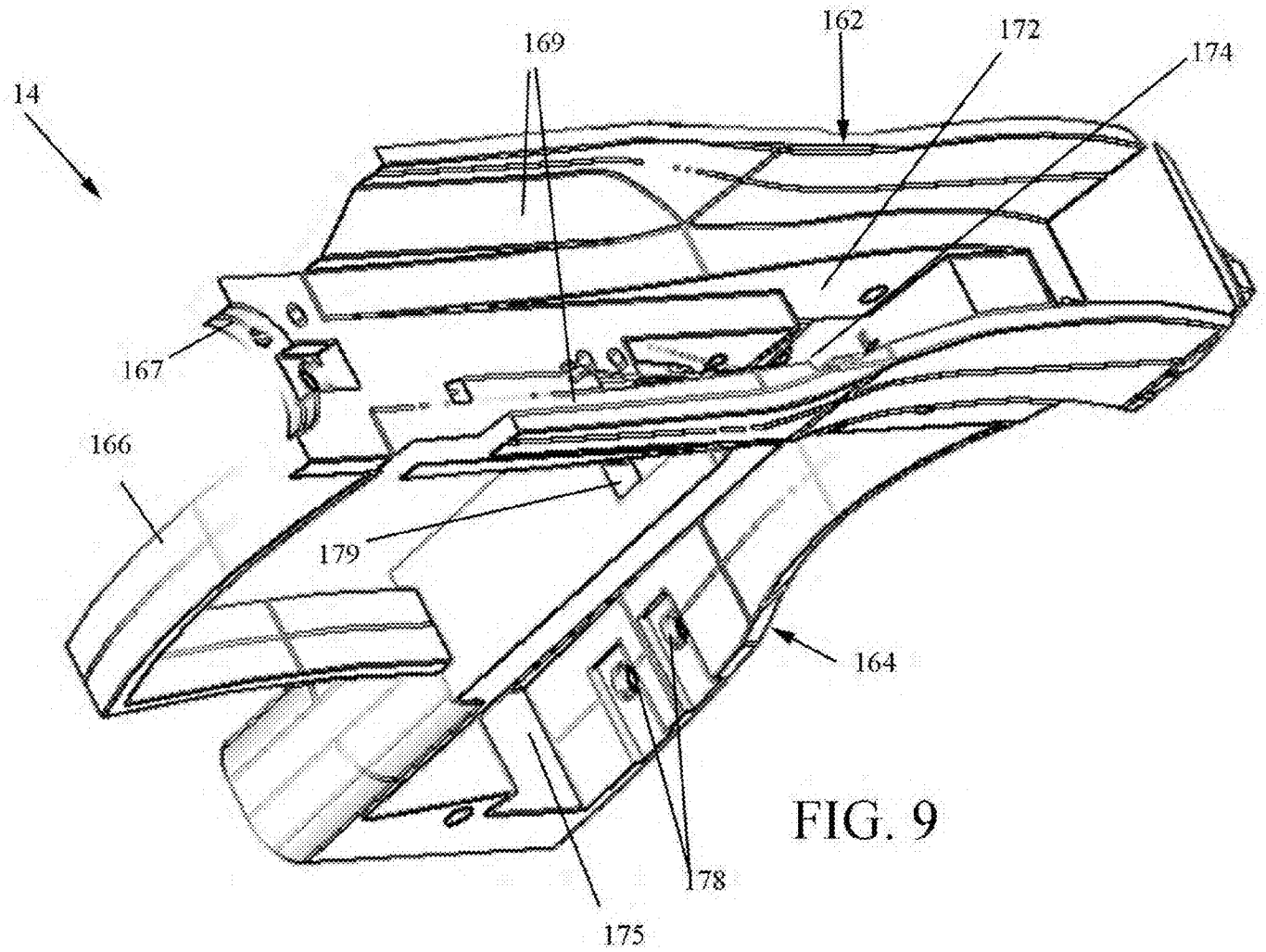
FIG. 9 is a side perspective view of the grip frame 14.

As seen in FIG. 9 the grip frame 14 may be a unitary molded component formed with horizontal sleeve 162, a downwardly extending handle 164, and a trigger guard 166 arched about the intersection of handle 164 and sleeve 162. The sleeve 162 is defined by a forward collar 167 which embraces and is attached to the receptacle 122 of body 12 below the volume chamber 115. The sleeve 162 also has opposing upwardly protruding walls 169 inwardly contoured to conform to the exterior of the cylinder of body 12 which is seated therein. A recess 172 is provided toward the rear of sleeve 162 for seating and positioning the HP solenoid valve 144. The recess 172 has drains to the internal air passage 125 that routes tank air from tank 120 through the handle 14. The handle 164 is substantially hollow and open-faced to form an enclosure 175 for the PC card 121, and is sealed by rubber or plastic grips (not shown). The trigger 119 (FIG. 1) is pivoted to the handle 164 and is spring-biased outward, and trigger 119 extends an adjustable set screw 111 rearwardly (see FIG. 2) through a small aperture 179 at the front top of handle 164 for actuation of the microswitch 120 on PC card 121. When the trigger 119 is pulled the set screw 111 pulls forward and contacts the microswitch 120. Holes 178 provide access to other microswitches on the PC card 121 for turning it on and off.

Figure 10:
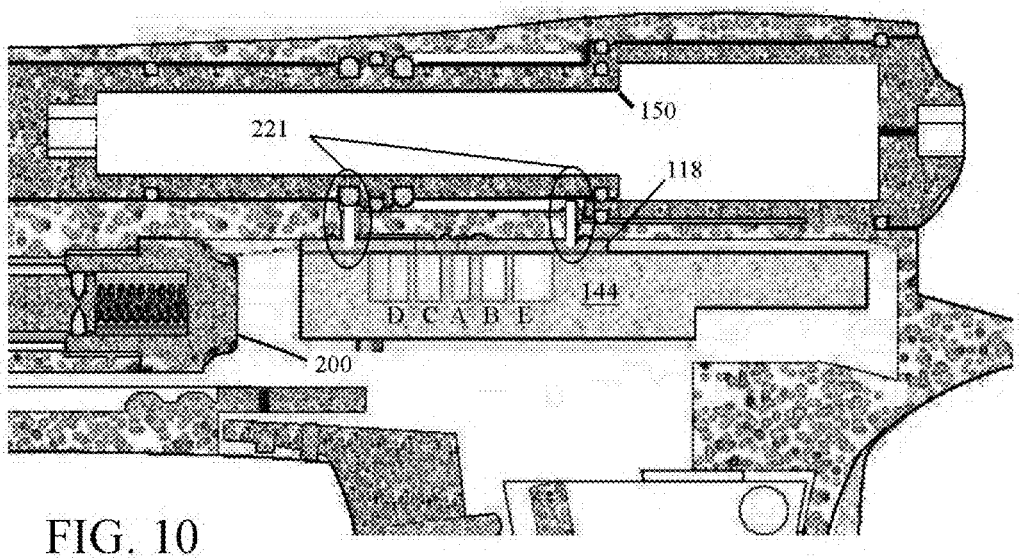
FIG. 10 is a side cross-section of the marker 10 showing the feed ports 221 for the bolt assembly 150.
Figure 11:
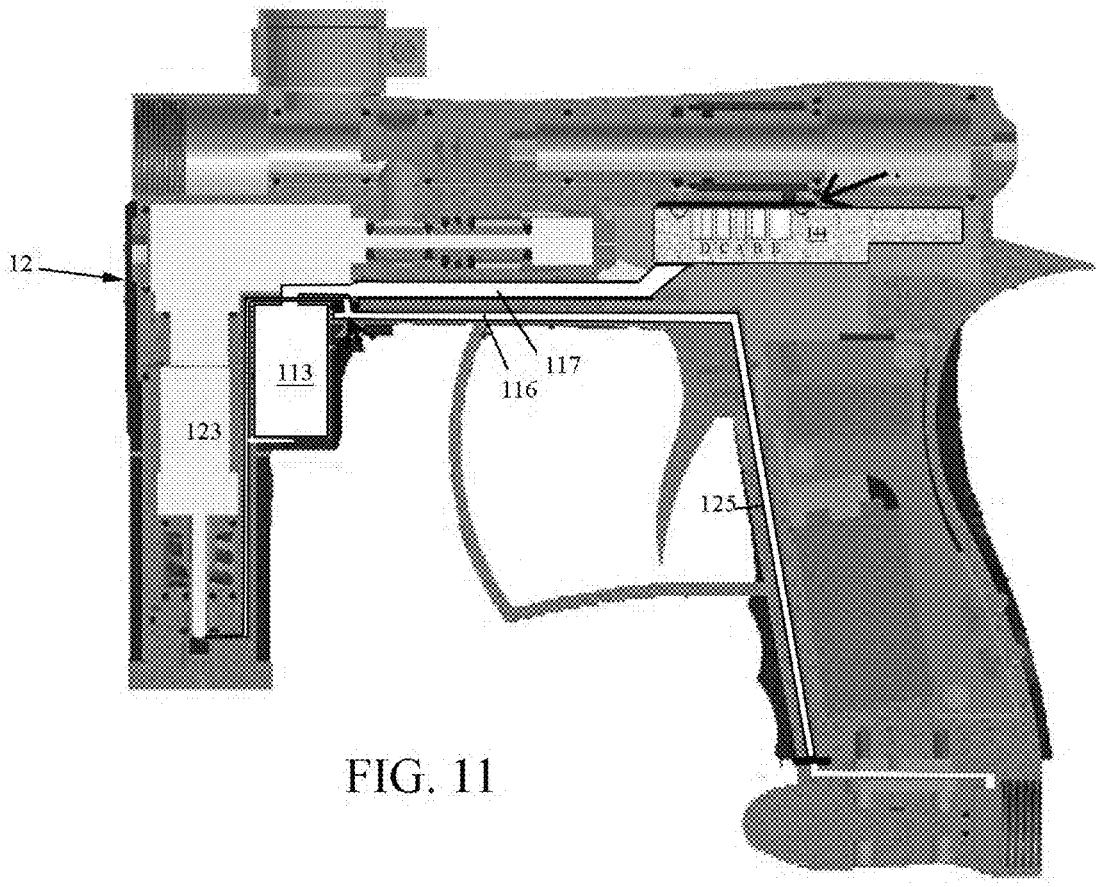
FIG. 11 is a side cross-section showing the HP and LP body passages 116, 117.

FIGS. 10-11 are side cross-sections of the marker 10 illustrating airflow through the marker 10. FIG. 10 shows the two vertical feed ports 221 by which LP Solenoid valve 144 ports air in front of and behind the bolt assembly 150. FIG. 11 shows a low pressure (LP) body passage 117 that communicates low pressure (20-60 psi) air from LP regulator 113 to the feed ports 221 and LP solenoid valve 144 of FIG. 10. Also seen in FIG. 11 is the routing of the grip frame passage 125 which is coupled to a second high pressure (HP) body passage 116. The HP body passage 116 communicates both with vertically mounted HP regulator 123 and LP regulator 113 to the feed ports 221 and down through the grip frame passage 125 to the tank regulator 126 and air tank 120.

Figure 12:
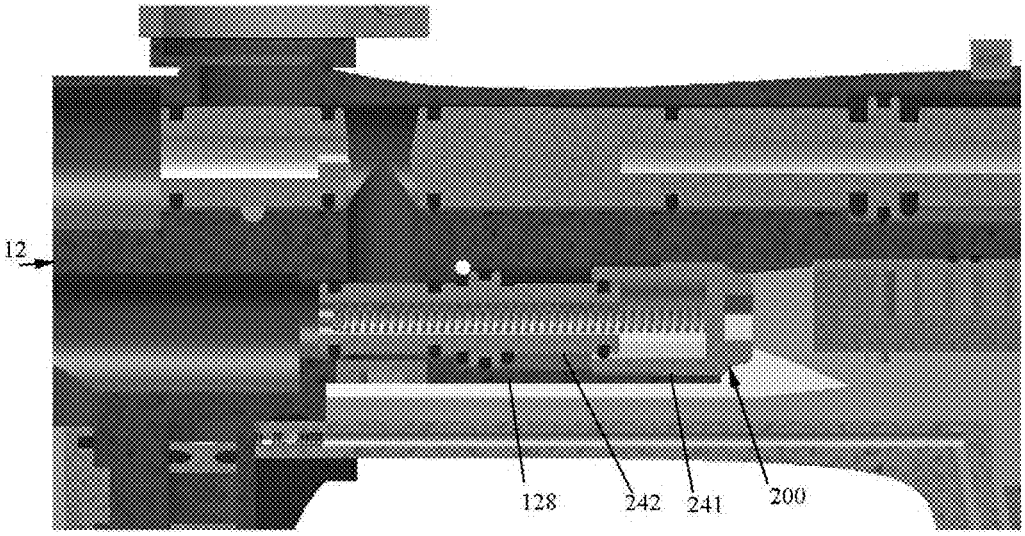
FIG. 12 is a side cross-section of body 12.

FIG. 12 is a side cross-section of marker 10 illustrating the exhaust valve 200 and how the exhaust valve 200 and HP solenoid valve 42 are seated in the body 12. The exhaust valve 200 comprises a cap 241 threaded into the body 12 and containing a spring-loaded cylinder 242 with an O-ring sail, very similar in shape and function to the bolt assembly 150. The exhaust valve 200 essentially serves as a spring-loaded cork to the volume chamber 15 and breach B, and the HP solenoid valve 142 controls its actuation. When the HP solenoid valve 142 energizes, air flows through the open inlet atop the cylinder 242 which pushes against the O-ring sail, moving the exhaust valve 200 rearward. As the exhaust valve 200 moves it uncorks the opening to the breech B, and the volume chamber 115 vents, propelling the paintball. The HP solenoid valve 142 then de-energizes, and the spring-loaded cylinder 242 returns as the exhaust valve 200 returns to its initial at-rest position. The cap 241 at the rear of the exhaust valve holds everything in place. The cylinder 242 of the exhaust valve 200 is hollow to seat the spring of cylinder 242, and it allows high pressure air to flow to the rear of the exhaust valve 200 into a chamber. Having air on both sides of the exhaust valve 200 balances the pressures and minimizes the work that must be done by the HP solenoid valve 142 which pilots the exhaust valve.

With combined reference to FIG. 2, the body 12 is formed with two side-by-side rearwardly directed receptacles 127, 128 for seating the HP solenoid valve 42 and the exhaust valve 200, respectively.

Figure 13:
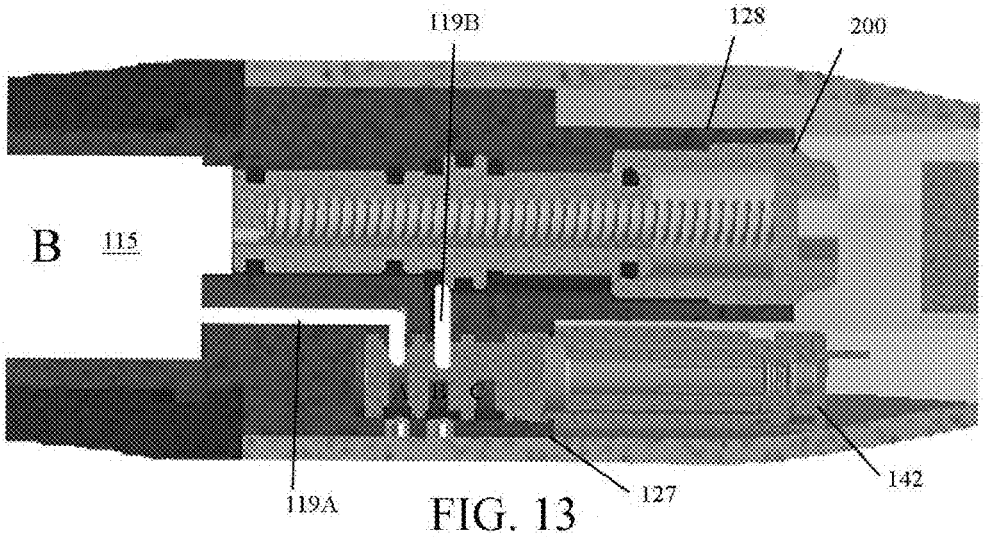
FIG. 13 is a top cross-section of body 12.

FIG. 13 is a top cross-section of body 12 illustrating the side-by-side seating of the HP solenoid valve 42 and the exhaust valve 200 in rearwardly directed receptacles 127, 128 within body 12. FIG. 13 also shows the firing ports 114 between the volume chamber 115, HP solenoid valve 42 and the exhaust valve 200. One port 119A extends within the body 12 from volume chamber 115 to port A of HP solenoid valve 42 and is vented through and outside. Another port 119B extends within the body 12 from an external vent to port B of HP solenoid valve 42 and continues across to the exhaust valve 200. The exhaust valve 200 interfaces directly with the volume chamber 115. This way, actuation of the HP solenoid valve 142 immediately releases the exhaust valve 200, which in turn evacuates high pressure air from the volume chamber 15 into the breech B to fire the paintball.

The above-described design and its use of two electro-pneumatic solenoid valves 142, 144 greatly increases reliability and smoothness of operation, and allows a marker that is smaller, lighter and more reliable. The marker has far fewer moving parts and a smaller moving mass, resulting in substantial recoil reduction. Eliminating the need for a ram to strike a valve assembly further reduces recoil and improves the overall operation of the paintball gun. Moreover, the design is more modular which allows for easier disassembly and maintenance.

Therefore, having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A paintball marker, comprising:

a body having a transverse internal cylinder bore defined by a breech and firing chamber;

a substantially hollow grip frame extending from said body;

a PC card mounted in the hollow of said grip frame, said PC card comprising a programmable controller and a microswitch;

a trigger attached to said grip frame and extending both externally and internally of said grip frame for selective engagement with said microswitch when moved externally;

a bolt assembly seated in the cylinder bore of said body, said bolt assembly being movable between a loading position and a ready-to-fire position, a tank supply of high-pressure compressed gas;

a high-pressure (HP) regulator seated in said body in fluid communication with said tank supply for regulating said tank supply to a high-pressure range;

a low-pressure (LP) regulator seated in said body in fluid communication with said tank supply for regulating said tank supply to a low-pressure range;

a low pressure solenoid valve in fluid communication with said low-pressure regulator and in electronic communication with said controller for actuation by said trigger to admit said lower pressure compressed gas into said internal cylinder bore for reciprocating said ram;

a high-pressure solenoid valve in fluid communication with said HP pressure regulator and in electronic communication with said controller for actuation by said trigger to admit said high pressure compressed gas into the breech of said internal cylinder bore for firing a paintball.

2. The paintball marker of claim 1, wherein said bolt assembly comprises a screw-threaded removable bolt head.

3. The paintball marker of claim 1, wherein said bolt assembly comprises an elongate cylindrical mid-section having a diameter, a cylindrical sail section attached to said mid-section having a greater diameter than said mid-section, and a bolt head comprising a cylindrical bolt tip affixed to a screw-threaded stem that is screwed into said mid-section.

4. The paintball marker of claim 1, further comprising an internal air passage running from said tank air supply to said body through said grip frame.

5. The paintball marker of claim 1, wherein said LP solenoid valve and HP solenoid valve are actuated in synchronous sequence by said controller.

6. The paintball marker of claim 1, further comprising an exhaust valve, said high pressure solenoid valve actuating said exhaust valve.

7. The paintball marker of claim 6, wherein said exhaust valve comprises a cap, and a spring-loaded cylinder.

8. The paintball marker of claim 7, wherein said spring-loaded cylinder includes a central pass-through aperture for equalizing high-pressure air.

9. The paintball marker of claim 6, wherein said exhaust valve and high pressure solenoid valve are seated side-by-side in said body.

10. The paintball marker of claim 1, further comprising an HP air passage through said body for porting high pressure air to said HP solenoid valve.

11. The paintball marker of claim 1, further comprising an LP air passage through said body for porting low pressure air to said bolt assembly.

12. The paintball marker of claim 4, further comprising a high-pressure air passage through said body, and a low-pressure air passage through said body, both of said high-pressure body air passage and low-pressure body air passage being in fluid communication with the grip frame air passage.

13. The paintball marker of claim 1, wherein said low pressure solenoid valve is a four-way solenoid valve.

14. The paintball marker of claim 13, wherein said high pressure solenoid valve is a three-way solenoid valve.

15. The paintball marker of claim 13, further comprising a manifold between said low pressure solenoid valve and said cylinder bore for manifolding compressed gas into said bolt assembly.

16. The paintball marker of claim 1, wherein said low pressure regulator and said high pressure regulator are both adjustable.

17. The paintball marker of claim 1, wherein said low pressure solenoid valve and said high pressure solenoid valve are configured for operation according to an open bolt firing sequence.

18. The paintball marker of claim 1, wherein said low pressure solenoid valve and said high pressure solenoid valve are configured for operation according to a closed bolt firing sequence.

19. A paintball marker, comprising:

a body having an internal cylinder bore;

a grip frame extending from said body;

a PC card mounted in a recess of said grip frame, said PC card comprising a programmable controller and a microswitch;

a trigger extending from external to said grip frame into said recess for selective engagement with said microswitch;

a bolt assembly seated in the cylinder bore of said body, said bolt assembly being movable between a loading position and a ready-to-fire position, a tank supply of compressed gas;

a regulator seated in said body in fluid communication with said tank gas supply for regulating said tank gas;

a first solenoid valve in fluid communication with said regulator and in electronic communication with said controller for actuation by said trigger to admit said compressed gas into said internal cylinder bore for reciprocating said bolt assembly;

a second solenoid valve in fluid communication with said regulator and in electronic communication with said controller for actuation by said trigger to admit said compressed gas into the cylinder bore for firing a paintball.

20. The paintball marker of claim 19, wherein said bolt assembly comprises a screw-threaded removable bolt head.

21. The paintball marker of claim 19, further comprising an internal air passage running from said tank air supply to said body through said grip frame, a high pressure air passage through said body, and a low pressure air passage through said body for porting low pressure air to said bolt assembly.

22. The paintball marker of claim 1, further comprising an exhaust valve, said high pressure solenoid valve actuating said exhaust valve.

23. The paintball marker of claim 22, wherein said exhaust valve and high pressure solenoid valve are seated side-by-side in said body.

24. The paintball marker of claim 1, wherein said low pressure solenoid valve is a four-way solenoid valve.

25. The paintball marker of claim 13, wherein said high pressure solenoid valve is a three-way solenoid valve.

26. The paintball marker of claim 24, wherein said low pressure solenoid valve and said high pressure solenoid valve are configured for operation according to an open bolt firing sequence.

27. The paintball marker of claim 24, wherein said low pressure solenoid valve and said high pressure solenoid valve are configured for operation according to a closed bolt firing sequence.

* * * * *